US005242469A

United States Patent [19]

Sakakibara et al.

[11] Patent Number: 5,242,469

[45] Date of Patent: Sep. 7, 1993

[54] GASOLINE ADDITIVE COMPOSITION

[75] Inventors: Tadamori Sakakibara, Iruma; Yutaka Hasegawa, Kawagoe; Fumio Oohashi, Higashi-Matsuyama; Kiyomi Adachi, Kami-Fukuoka, all of Japan

[73] Assignee: Tonen Corporation, Tokyo, Japan

[21] Appl. No.: 706,598

[22] Filed: May 30, 1991

[30] Foreign Application Priority Data

| | | | |
|---|---|---|---|
| Jun. 7, 1990 | [JP] | Japan | 2-149388 |
| Jun. 7, 1990 | [JP] | Japan | 2-149389 |
| Jul. 30, 1990 | [JP] | Japan | 2-204899 |
| Jul. 30, 1990 | [JP] | Japan | 2-204901 |
| Jul. 30, 1990 | [JP] | Japan | 2-204902 |
| Jul. 30, 1990 | [JP] | Japan | 2-204904 |

[51] Int. Cl.[5] ..... C10L 1/18; C10L 1/22

[52] U.S. Cl. ..... 44/347; 44/389; 44/445

[58] Field of Search ..... 44/389, 347, 445

[56] References Cited

U.S. PATENT DOCUMENTS

| | | | |
|---|---|---|---|
| 3,438,757 | 4/1969 | Honnen et al. | 44/58 |
| 3,443,918 | 5/1969 | Kautsky et al. | 44/63 |
| 3,658,495 | 4/1972 | Dorer, Jr. | 44/400 |
| 3,717,446 | 2/1973 | Howland et al. | 44/347 |
| 3,756,793 | 9/1973 | Robinson | 44/62 |
| 3,925,030 | 12/1975 | Garth | 44/445 |
| 3,994,698 | 11/1976 | Worrell | 44/415 |
| 4,032,304 | 6/1977 | Dorer, Jr. et al. | 44/389 |
| 4,039,300 | 8/1977 | Chloupek et al. | 44/347 |
| 5,004,478 | 4/1991 | Vogel et al. | 44/398 |
| 5,006,130 | 4/1991 | Aiello et al. | 44/432 |
| 5,089,028 | 2/1992 | Abramo et al. | 44/347 |

FOREIGN PATENT DOCUMENTS

| | | |
|---|---|---|
| 0235868 | 9/1987 | European Pat. Off. . |
| WO91/12302 | 8/1991 | PCT Int'l Appl. . |
| 1310847 | 3/1973 | United Kingdom . |
| 2026507A | 2/1980 | United Kingdom . |

*Primary Examiner*—Jacqueline V. Howard
*Attorney, Agent, or Firm*—Nixon & Vanderhye

[57] ABSTRACT

A gasoline additive composition comprising an ester; and at least one dispersant component chosen from the group consisting of a specified monosuccinimide, a specified bissuccinimide, an alkylamine of average molecular weight 500–5000 having a polyolefine polymer as an alkyl group and a specified benzylamine derivative of average molecular weight 500–5000. It can contain a polyoxyalkylene glycol or its derivative. It can further contain a lubricant oil fraction of viscosity in the range 3–35 $mm^2/s$ (100° C.) It prevents undesired deposits on the surfaces of intake valves of an automobile engine.

19 Claims, No Drawings

GASOLINE ADDITIVE COMPOSITION

BACKGROUND OF THE INVENTION

1. Field of the Invention

This invention concerns a gasoline additive composition and, in particular, a gasoline additive composition which considerably reduces deposits in the intake valves of automobile engines.

2. Prior Art

In the prior art, some compounds such as polyalkenyl succinimide and hydroxypolyether polyamine are known as cleaning agents for automobile carburetors and engines In addition, dispersions or solutions of polyalkenyl succinimide and oxy compounds in organic solvents such as xylene are known as gasoline additive compositions These substances however were not fully satisfactory.

An object of this invention is to improve gasoline additive compositions.

A further object of this invention is to provide a gasoline additive composition which in particular can considerably reduce deposits in the intake valves of engines.

Other objects of this invention will become apparent from the following description.

SUMMARY OF THE INVENTION

This invention, as the first aspect, includes a gasoline additive composition comprising an ester; and at least one dispersant component chosen from the group consisting of a monosuccinimide represented by the general formula (I) below, a bissuccinimide represented by the general formula (II) below, an alkylamine of average molecular weight 500–5000 having a polyolefine polymer as an alkyl group and a benzylamine derivative of average molecular weight 500–5000 represented by the general formula (III) below:

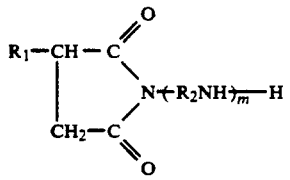

(I)

wherein $R_1$ is an olefine oligomer group with no less than 30 carbon atoms, $R_2$ is an alkylene group with 2 to 4 carbon atoms, and m is an integer of 1–10,

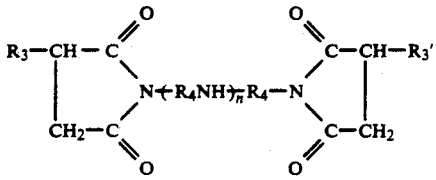

(II)

wherein each of $R_3$ and $R_3'$ is olefine oligomer group with no less than 30 carbon atoms, $R_4$ is an alkylene group with 2 to 4 carbon atoms provided that the multiple $R_4$ groups may by the same as or different from each other, and n is an integer of 0–10,

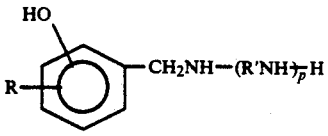

(III)

wherein R is an alkyl group derived from a polyolefine polymer of average molecular weight 500–4500, R' is an alkylene group, and p is an integer of 1–10.

This invention, as the second aspect, includes a gasoline additive composition comprising the above composition together with a polyoxyalkylene glycol or its derivative.

This invention can further contain a lubricant oil fraction of viscosity in the range 3 $mm^2/s$–35 $mm^2/s$ (100° C.).

In the gasoline additive composition of this invention, the succinimide, alkylamine or benzylamine derivative exhibits the property of preventing undesired deposits on the surface of the intake valves by covering the surface in a fluid form, together with the polyoxyalkylene glycol or its derivative and/or the ester.

The ester possibly has the property of preventing formation of the deposits on the surface of the intake valves. Further, It also possibly functions as a carrier oil by increasing the fluidity of the succinimide, alkylamine, and polyoxyalkylene glycol or its derivative on the surface of these valves after evaporation of gasoline, and hence increasing their solubility in gasoline Further, the lubricant oil fraction optionally added as a carrier oil is highly compatible with the alkylamine, ester, polyoxyalkylene glycol and its derivative. The fraction is consequently able to increase the fluidity of the alkylamine, polyoxyalkylene- glycol or its derivative, after evaporation of gasoline, on the surface of the intake valves, and to increase their solubility in gasoline. The fraction therefore has the property of preventing formation of the deposits.

In the gasoline additive composition of this invention, each of the components has the property of preventing adhesion of the deposits Further, the ester and lubricant oil fraction appear to function as suitable carrier oils for the composition of this invention, and the composition therefore also has an excellent dispersing action in gasoline. Due to these effects of preventing adhesion and increasing dispersion, this invention effectively prevents adhesion of the deposits to the metal surfaces of the intake valves.

Further, the composition of this invention has an excellent thermal stability.

DETAILED DESCRIPTION OF THE PREFERRED EMBODIMENTS

We shall first describe the succinimide, alkylamine and benzylamine derivative (Dispersant Component) used in the 1st and 2nd aspects of this invention.

Succinimide

In general, the succinimide is prepared by reacting a polyolefine polymer, obtained by polymerization of olefines in the presence of a polymerization catalyst, together with maleic anhydride to form a polyalkenyl succinic anhydride, and then reacting the polyalkenyl succinic anhydride with a polyalkylene polyamine in a diluent. In this preparation, any monosuccinimide can be obtained by reacting the polyalkenyl succinic anhydride and polyalkylene polyamine in a mole ratio of 1:1, and any bissuccinimide can be obtained by reacting these components in a mole ratio of 2:1.

From the viewpoint of compatibility with gasoline, the polyolefine polymer constituting the succinimide should have no less than 30, and preferably 40–400 carbon atoms, and its average molecular weight is desired to be in the range 500–5,000. Olefine used for preparing the polyolefine may for example be an α-olefine with 2–8 carbon atoms such as ethylene, propylene, 1-butene, isobutylene, 1-hexene, or 2-methylpentene-1,1-octene. The polyolefine polymer is preferably polypropylene or polyisobutylene with the average molecular weight of 500–5000.

The polyalkylene polyamine used in the synthesis of the succinimide is preferably selected so that the number "m" of repeating unit in the formula (I) will become 1–10. Examples thereof are polethylene polyamine, polypropylene polyamine and polybutylene polyamine, polyethylene polyamine being particularly preferable.

Further, in the composition of this invention, a mixture of said monosuccinimide and bissuccinimide is particularly effective.

The proportion of this succinimide added to gasoline is typically in the range 10 ppm–5000 ppm on the basis of the total weight of gasoline.

Alkylamine

The alkylamine used in this invention has a polyolefine polymer as an alkyl group. Olefine used for preparing the polymer may for example be an α-olefine with 2–8 carbon atoms such as ethylene, propylene, 1-butene, isobutylene, 1-hexene, or 2-methylpentene-1,1-octene. The polyolefine polymer is preferably polypropylene or polyisobutylene.

The alkylamine may for example be prepared by reacting said polyolefine polymer with cyanoethylene to obtain polyalkenyl cyanoethane, and then hydrogenating the polyalkenyl cyanoethane in the presence of a hydrogenation catalyst.

The alkylamine should have an average molecular weight of 500–5000, and preferably 1000–3000. If the molecular weight is less than 500, the ability to prevent the adhesion of deposits declines remarkably. If it is greater than 5000, fluidity of the alkylamine on the air intake valve surface declines and the alkylamine itself becomes a source of the deposits.

The proportion of the alkylamine added to gasoline is typically in the range 10 ppm–5000 ppm on the basis of the total weight of gasoline.

Benzylamine Derivative

The benzylamine derivative represented by the above general formula (III) may for example be prepared by alkylating 2-hydroxybenzylamine with a polyolefine polymer in the presence of an acid catalyst, and then reacting the resultant with polyalkylene polyamine.

A monomer component of said polyolefine polymer may for example be an α-olefine with 2–8 carbon atoms such as ethylene, propylene, 1-butene, isobutylene, 1-hexene, or 2-methylpentene-1,1-octene. Propylene or isobutylene is prefarable. From the viewpoint of compatibility with gasoline, the molecular weight of the polyolefine polymer is desired to be in the range 50–4500.

Further, the polyalkylene polyamine polymer is preferably selected so that the number "p" of the repeating unit in the formula (III) will become 1–10. Examples thereof are polyethylene polyamine, polypropylene polyamine and polybutylene polyamine, polyethylene polyamine being particularly preferable.

The benzylamine derivative in accordance with the invention should have an average molecular weight of 500–5000, and preferably 1000–3000. If the molecular weight is less than 500, the ability to prevent the adhesion of deposits declines remarkably. If it is greater than 5000, fluidity of the derivative on the air intake valve surface declines and the derivative itself becomes a source of the deposits.

The proportion of the benzylamine derivative added to gasoline is typically in the range 10 ppm–5000 ppm on the basis of the total weight of gasoline.

Ester

We shall next describe the ester used in the 1st and 2nd aspects of this invention. This ester may be a monoester, diester or polyolester.

The monoester can be obtained by esterifying an organic acid having no less than 4 carbon atoms with an alcohol having no less than 4 carbon atoms.

Examples of the alcohol include n-butanol, isobutanol, n-pentanol, isopentanol, n-hexanol, isohexanol, n-heptanol, isoheptanol, octanol, 2-ethylhexanol, n-nonylalcohol, isononylalcohol, n-decylalcohol, isodecylalcohol, undecanol, laurylalcohol, stearylalcohol. Preferable ar 2-ethylhexanol, isononylalcohol and isodecylalcohol.

Examples of the organic acid esterified with such an alcohol include n-butanoic acid, isobutanoic acid, n-pentanoic acid, isopentanoic acid, n-hexanoic acid, 2-ethylbutanoic acid, cyclohexanoic acid, n-heptanoic acid, isoheptanoic acid, methylcyclohexanoic acid, n-octanoic acid, dimethylhexanoic acid, 2-ethylhexanoic acid, 2,4,4-trimethylpentanoic acid, isooctanoic acid, 3,5,5-trimethylhexanoic acid, n-nonanoic acid, isononanoic acid, isodecanoic acid, isoundecanoic acid, 2-butyloctanoic acid, tridecanoic acid, tetradecanoic acid, hexadecanoic acid and octadecanoic acid, Preferable are heptanoic acid, n-octanoic acid and 2-ethylhexanoic acid.

The monoester can be synthsized from such an alcohol and organic aci by coventional processes, for example dehydration condensation in the presence of an acid catalyst.

Preferred monoesters include isodecyl butanoate, isodecyl heptanoate, isodecyl octanoate, 2-ethylhexyl hexanoate,2-ethylhexyl octanoate, 2-ethylhexyl decanoate, isononyl heptanoate, isononyl nonylate and isononyl undecanoate.

The diester which can be used in the invention may be synthesized by esterification of a dicarboxylic acid with an alcohol.

Examples of the above alcohol include methanol, ethanol, n-propanol, isopropanol, n-butanol, isobutanol, n-pentanol, isopentanol, n-hexanol, isohexanol, n-heptanol, isoheptanol, octanol, 2-ethylhexanol, n-nonylalcohol, isononylalcohol, n-decylalcohol, isodecylalcohol, undecanol, laurylalcohol and stearyl alcohol. Preferable are 2-ethylhexanol, isononylalcohol and isodecylalcohol.

Examples of the dicarboxylic acid esterified with such an alcohol include malonic acid, succinic acid, glutaric acid, adipic acid, gmelic acid, suberic acid, azelaic acid, sebacic acid, undecanedioic acid, dodecanedioic acid, tridecanedioic acid, tetradecanedioic acid, pentadecanedioic acid, hexadecanedioic acid, heptadecanedioic acid, octadecanedioic acid, nonadecanedioic acid, eicosanedioic acid, phthalic acid and terephthalic acid. Preferable are adipic acid, azelaic acid, sebacic acid and phthalic acid.

Diesterification reactions of such an alcohol and dicarboxylic acid are carried out by conventional processes, for example dehydration condensation in the presence of an acid catalyst.

Preferred diesters include di-(2-ethylhexyl)adipate, dioctyl adipate, diisononyl adipate, diisodecyl adipate, di(2-ethylhexyl)azelate, diisononyl azelate, dioctyl sebacate, diisodecyl sebacate and di(2-ethylhexyl)phthalate.

The polyolester in accordance with an embodiment of the invention can be obtained by reacting a polyol having 5–9 carbon atoms with an organic acid having 4–18 carbon atoms.

Examles of the polyol include 2,2-dimethylpropane-1,3-diol (or neopentyl glycol), 2-ethyl-2-butyl-propane-1,3-diol, 2,2-diethylpropane-1,3-diol, 2,2-dibutylpropane-1,3-diol, 2-methyl-2-propylpropane-1,3-diol, 2-ethyl-2-butylpropane-1,3-diol, trimethylolethane, trimethylolpropane, trimethylolbutane and pentaerythritol. Preferable are neopentylglycol, 2-methyl-2-propylpropane-1,3-diol, trimethylolpropane, and pentaerythritol, and in particular preferable are neopenthylglycol, trimethylolpropane, and pentaerythritol.

Examples of the organic acid esterified with such a polyol include n-butanoic acid, isobutanoic acid, n-pentanoic acid, isopentanoic acid, n-hexanoic acid, 2-ethylbutanoic acid, cyclohexanic acid, n-heptanoic acid, isoheptanoic acid, methylcyclohexanoic acid, n-octanoic acid, dimethylhexanoic acid, 2-ethylhexanoic acid, 2,4,4-trimethylpentanoic acid, isooctanoic acid, 3,5,5-trimethylhexanoic acid, n-nonanoic acid, isononanoic acid, isodecanoic acid, isoundecanoic acid, 2-butyloctanoic acid, tridecanoic acid, tetradecanoic acid, hexadecanoic acid and octadecanoic acid. Preferable are heptanoic acid, n-octanoic acid and 2-ethylhexanoic acid.

Synthesis of the polyolester from such an organic acid and polyol may be carried out by conventional processes, for example dehydration condensation in the presence of an acid catalyst.

Preferred polyols include as follows (hereinafter neopentyl referred to as NPG; trimethylolpropane as TMP; and pentaerythritol as PE):

NPG/di-(heptanoate), NPG/di-(2-ethylbutyrate), NPG/di-(cyclohexanoate), NPG/di-(heptanoate), NPG/di-(isoheptanoate), NPG/di-(octylate), NPG/di-(2-ethylhexanoate), NPG/di-(2-isooctanoate), NPG/di-(isononylate), NPG/di-(isodecanoate), NPG/di-{mixed(hexanoate, heptanoate)}, NPG/di-{mixed(hexanoate, octanoate)}, NPG/di-{mixed(hexanoate, nonylate)}, NPG/di-{mixed(heptanoate, octanoate)}, NPG/di-{mixed(heptanoate, nonylate)}, NPG/di-{mixed(heptanoate, isooctanoate)}, NPG/di-{mixed(heptanoate, isononylate)}, NPG/di-{mixed(isooctanoate, isononylate)}, NPG/di-{mixed(butanoate, tridecanoate)}, NPG/di-{mixed(butanoate, tetradecanoate)}, NPG/di-{mixed(butanoate, hexadecanoate)}, NPG/di-{mixed(butanoate, octadecanoate)}, NPG/di-{mixed(hexanoate, isooctanoate, isononylate)}, NPG/di-{mixed(hexanoate, isooctanoate, isodecanoate)}, NPG/di-{mixed(heptanoate, isooctanoate, isononylate)}, NPG/di-{mixed(heptanoate, isooctanoate, isodecanoate)}, NPG/di-{mixed(octanoate, isononylate, isodecanoate)}; TMP/tri-(pentanoate), TMP/tri-(hexanoate), TMP/tri-(heptanoate), TMP/tri-(octanoate), TMP/tri-(nonylate), TMP/tri-(isopentanoate), TMP/tri-(2-ethylbutyrate), TMP/tri-(isopentanoate), TMP/tri-(isooctanoate), TMP/tri-(2-ethylhexanoate), TMP/tri-(isononylate), TMP/tri-(isodecanoate), TMP/tri-{mixed(butyrate, octadecanoate)}, TMP/tri-{mixed(hexanoate, hexadecanoate)}, TMP/tri-{mixed(heptanoate, tridecanoate)}, TMP/tri-{mixed(octanoate, decanoate)}, TMP/tri-{mixed(octanoate, nonylate)}, TMP/tri-{mixed(butyrate, heptanoate, octadecanoate)}, TMP/tri-{mixed(pentanoate, heptanoate, tridecanoate)}, TMP/tri-{mixed(hexanoate, heptanoate, octanoate)}; Pe/tetra(pentanoate), Pe/tetra(hexanoate), Pe/tetra(isopentanoate), Pe/tetra(2-ethybutyrate), Pe/tetra(isoheptanoate), Pe/tetra(isooctanoate), Pe/tetra(2-ethylhexanoate), Pe/tetra(isononylate), Pe/tetra(oleate); and esters derived from linear or branched carboxylic acid having 4 to 8 carbon atoms and PE.

Further, the ester may for example be obtained using neopentylpolyol other than NPG, TMP and PE, i.e. 2-methyl-2-propylpropane-1,3-diol, 2,2-diethylpropanediol, trimethylolethane or trimethylolhexane,-together with the above-mentioned organic acid alone or in admixture.

The proportion of these esters added to gasoline is typically in the range 10 ppm–5000 ppm on the basis of the total weight of gasoline.

Plyoxyalkylene Glycol

We shall next describe the polyoxyalkylene glycol used in the 2nd aspect of this invention.

This compound is represented by the general formula:

$$HO—R_5—OR_5)_q—OH$$

wherein $R_5$ is an alkylene group which is preferably ethylene, propylene, or butylene, and q is an integer of 5–110. The multiple $R_5$ groups may be the same or different, and preferably consist of at least two of ethylene, propylene and butylene.

Further, examples of polyoxyalkylene glycol derivatives are ethers, esters or ether aminoacid esters of the polyoxyalkylene glycol.

The above ethers may be monoethers represented by the general formula:

$$R_6O—R_5—(OR_5)_q—OH$$

or diethers represented by the general formula:

$$R_6O—R_5—(OR_5)_q—OR_6$$

wherein group $R_5$ is the same as above, and $R_6$ represents an aliphatic, alicyclic or aromatic hydrocarbon group. The groups $R_6$ in the diethers may be the same or different.

Preferred $R_6$ is methyl, ethyl, propyl, isopropyl, butyl, isobutyl, t-butyl, pentyl, hexyl, heptyl, octyl, nonyl, decyl, phenyl, benzyl, tolyl, xylyl, phenethyl, p-methoxyphneyl, cyclohexyl or cyclopentyl.

The above esters may be monoesters represented by the general formula:

$$R_6COO—R_5—(OR_5)_q—OCOR_7$$

or diesters represented by the general formula:

$$R_7COO—R_5—(OR_5)_q—OCOR_7$$

wherein $R_5$ and $R_6$ are the same as above, or $R_6$ may also be hydrogen, and $R_7$ represents an aliphatic acid residue. The groups $R_7$ in the diesters may be the same or different.

Examples of $R_7$ include the residues of acetic acid, propynic acid, lactic acid, valeric acid, caproic acid, heptanoic acid, caprylic acid, pelargonic acid, n-decanoic acid, n-undecanoic acid, n-dodecanoic acid (lauric acid), n-pentadecanoic acid, n-heptadecanoic acid, n-hexadecanoic acid (palmitic acid), n-octadecanoic acid (stearic acid), n-eicosanoic acid, n-docosanoic acid(behenic acid), n-pentaeicosanoic acid, n-heptaeicosanoic acid, n-hexaeicosanoic acid, n-octaeicosanoic acid, n-triacontanoic acid, and mixed fatty acids derived from natural products such as fish fatty acid, tallow oil fatty acid and coconut oil fatty acid Fatty acids obtained by hydrogenating them are preferable.

The above ether aminoacid esters may be the ester from both polyoxyalkylene glycols or its monoalkylethers and ω-aminoaliphatic acid, represented by the general formula $$R_8—O—(R_9O)_x—CO—(CH_2)_y—NH_2$$

wherein $R_8$ is hydrogen or a lower alkyl group, $R_9$ is a lower alkylene group, x is an integer of 5–110, and y is an integer of 2–8.

$R_8$ is preferably methyl, ethyl, propyl, butyl, pentyl, hexyl or octyl. $R_9$ is preferably ethylene ($—CH_2—CH_2—$), propylene ($—CH(CH_3)—CH_2—$) or butylene ($—CH(C_2H_5)—CH_2—$).

The polyoxyalkylene glycol or its derivative should have a molecular weight of 500–5000, and preferably 1000–3000. If the molecular weight is less than 500, the ability to prevent adhesion of deposits declines remarkably. If it is greater than 5000, fluidity of said glycol-type compound on the intake valve surface declines and the compound itself becomes a source of the deposits The proportion of polyoxyalkylene glycol or its derivative added to gasoline is typically in the range 10 ppm–5000 ppm on the basis of the total weight of gasoline.

In this invention, the blending proportion by weight of said dispersant component (A), ester (B), and polyoxyalkylene glycol or its derivative (C) may be chosen suitably, but normally A:B=1:0.5–2.0, and preferably 1:0.5–1.0, or A:B:C=1:0.5–6.0:0.2–4.0, and preferably 1:1.0–3.0:0.5–2.0.

Further, if the dispersant component (A) is itself a mixture, the blending proportion thereof may be chosen suitably.

The gasoline additive composition of this invention is normally added to gasoline in a proportion of 0.001 wt %–5 wt %, and preferably 0.01 wt %–1 wt %.

Lubricant Oil Fraction

The lubricant oil fraction may also be added to the composition of this invention as a carrier oil, if necessary. This lubricant oil fraction may be a fraction having a viscosity of 3 $mm^2/s$–35 $mm^2/s$ (100° C.), for example, a hydrocarbon oil obtained by extracting oils distilled by low pressure distillation with a solvent such as phenol, furfural or N-methyl pyrrolidone, dewaxing the resultant raffinate with a solvent such as propane or methylethyl ketone, and then, if necessary, subjecting the product to purification by hydrogenation to improve color and remove unstable impurities (The hydrocarbon oil has 2%–20% of of aromatic carbon atoms on the basis of the total number of carbon atoms); or a mixture of this hydrocarbon oil with oil residues treated by solvent extraction, solvent dewaxing and solvent deasphalting. Further, catalytic dewaxing may also be carried out instead of the solvent dewaxing. Further, highly hydrogenated, purified oils (having no more than 2% of aromatic carbon atoms on the basis of the total number of carbon atoms) may also be used as the lubricant oil. These purified mineral oils may be paraffin, naphthene type, or mixtures thereof.

If the viscosity of these lubricant oil fractions is less than 3 $mm^2/s$, the fractions volatilize together with gasoline and no longer function as the carrier oil, whereas if the viscosity is greater than 35 $mm^2/s$, fluidity of the fractions declines and the oil fractions themselves become a source of deposits.

The lubricant oil fraction is typically used at a level of 0.1–5 parts by weight on the basis of 1 part by weight of the total additive.

The gasoline additive composition can be used or preserved in a form diluted with organic solvent. Examples of the organic solvent include kerosene, benzene, toluene, xylene, ethylbenzene, propylbenzene, trimethylbenzene, clorobenzene, methoxybenzene, ethoxybenzene, pentane, hexane, heptane, octane, nonane, decane, undecane, dodecane, cyclohexane, cyclopentane, N,N-dimethylformamide, N,N-dimethylacetoamide, ethylether, propylether, isopropylether, butylether, isoamylether, isobutylether, methyl n-propyl ether, methyl isobutyl ether, methyl amyl ether, ethyl n-butyl ether. In particular preferable are toluene, xylene, ethylbenzene and trimethylbenzene. Such solvents can be used alone or in combination.

The gasoline to which the composition of this invention is added is ordinary automobile fuel obtained from virgin naphtha, polymer gasoline or natural gasoline, or by catalytic cracking, thermal decomposition or catalytic reforming of stock oil, and it has a boiling point of gasoline fraction.

Further, apart from the components as described above, octane value improvers such as methyl-tert-butyl ether (MTBE), anti-static agents, anti-corrosive agents, anti-oxidants, anti-freeze agents, dyes and the like may also be added to the composition of this invention.

EXAMPLES

We hereinafter describe some examples of the gasoline additive composition of this invention, but it should be understood that the invention is in no way limited to these examples.

1st Aspect

Example 1 (Dispersant Component=Succinimide)

A sample oil 1 was prepared by adding:

(1) 200 ppm by weight of trimethylolpropane/tri-(2-ethylhexanoate), and (2) 300 ppm of a succinimide mixture comprising 50 wt % of a commercial mono-type succinimide (containing 20 wt % of the bis form) having a polyethylene polyamine moiety with m=4, $R_1$ of a polyisobutenyl group and average molecular weight of approx. 1500 (as measured by GPC), and 50 wt % of a commercial bis-type succinimide (containing 20 wt % of the mono form) having a polyethylene polyamine moiety with n=3, $R_3$ & $R_{3'}$ of polyisobutenyl groups, and a molecular weight of approx. 2500 (as measured by GPC), to gasoline of density 0.752 g/cm$^2$ (15° C.), Reid vapor pressure 0.750 Kgf/cm$^2$ (37.8° C.), aromatic content 40.2% and olefine content 19.6%, and 10%-, 50%-, 90%-recovered-temperature 46.5° C., 99.0° C., 147.0° C., respectively.

In preparing the sample, oil temperature was 40°-60° C., and stirring time was approx. 30 minutes.

An experiment was then carried out to measure deposits on the intake valves of an actual automobile using this sample oil 1, and a multi-grade oil as engine oil (SAE Engine Oil Viscosity No. 10W30).

For this experiment, a Toyota IG-FE engine (6 cylinders and 4 valves in series) connected to a dynamometer was used. After running the engine under specified conditions for 100 hours, it was dismantled and the intake valves removed. Adhesion of deposits was assessed visually on a 10 point scale from 1 to 10 according to CRC assessment criteria, with 1 corresponding to maximum adhesion and 10 corresponding to no adhesion. The valves were also weighed within 1 hour of their removal from the engine. The weight of adhere deposits was found by subtracting the weight of the clean valve determined before the experiment from the weight of the valve after the experiment.

The number of samples (intake valves) was n=12.

The results are shown in Table 1 below.

Example 2

A sample oil 2 was prepared by adding a lubricant oil fraction of viscosity 4.7 mm$^2$/s (100° C.) (150 neutral oil) to the gasoline additive composition of Example 1 such that it contained 300 ppm by weight of the fraction on the basis of the total weight of gasoline. Data of n-d-M analysis of the lubricant oil showed 70.0% paraffin carbon atoms, 25.0% naphthene carbon atoms and 5.0% carbon atoms on the basis of the total number of carbon atoms.

The same experiment as in Example 1 was carried out using this sample oil 2, and the results are shown in Table 1.

Example 3

A sample oil 3 was prepared in the same way as in Example 1, except that the succinimide mixture of Example 1 was replaced by a mixture of 70 wt % of mono-type succinimide and 30 wt % of bis-type succinimide. The same experiment as in Example 1 was carried out using this sample oil 3, and the results are shown in Table 1.

Example 4

A sample oil 4 was prepared by replacing the succinimide mixture of Example 1 with 300 ppm by weight of a lubricant oil fraction incorporated in 300 ppm by weight of the mono-type succinimide used in Example 1. The same experiment as in Example 1 was carried out using this sample oil 4, and the results are shown in Table 1.

Example 5

A sample oil 5 was prepared by replacing the succinimide mixture of Example 1 with 300 ppm by weight of a lubricant oil fraction incorporated in 300 ppm by weight of the bis-type succinimide used in Example 1.

The same experiment as in Example 1 was carried out using this sample oil 5, and the results are shown in Table 1.

Example 6

A sample oil 6 was prepared by replacing the polyolester of Example 1 with the same quantity of diisodecyladipate. The same experiment as in Example 1 was carried out using this sample oil 6, and the results are shown in Table 1.

Comparative Example 1

A comparison oil 1 was prepared using only gasoline without the addition of the additive in Example I. The same experiment as in Example 1 was carried out, and the results are shown in Table 1.

The results show that in the case of all the sample oils 1-6, adhesion of the deposits is reduced and cleanliness is improved as compared to the case of comparison oil 1.

TABLE 1

| | Adhesion Assessment (1) | Average Weight of Deposit (mg/intake valve) |
|---|---|---|
| Sample oil 1 | 9.0 | 56 |
| Sample oil 2 | 9.0 | 57 |
| Sample oil 3 | 9.0 | 60 |
| Sample oil 4 | 8.5 | 68 |
| Sample oil 5 | 8.8 | 64 |
| Sample oil 6 | 9.0 | 55 |
| Comparison oil 1 | 7.5 | 156 |

(1) CRC method

Example A1 (Dispersant Component=Alkylamine)

A sample oil A1 was prepared by adding:

(1) 300 ppm by weight on the basis of the total weight of gasoline, of polyisobutenylamine (average molecular weight 1500), and (2) 200 ppm by weight on the basis of the total weight of gasoline, of trimethylolpropane/tri-(2-ethylhexanoate), to gasoline of density 0.752 g/cm$^2$ (15° C.), Reid vapor pressure 0.750 Kgf/cm$^2$ (37.8° C.), aromatic content 40.2% and olefine content 19.6%, and 10%-, 50%-, 90%-recovered-temperature 46.5° C., 99.0° C., 147.0° C., respectively.

In preparing the sample, oil temperature was 40°-60° C., and stirring time was approx. 30 minutes.

An experiment was then carried out to measure deposits on the air intake valves of an actual automobile using this sample oil A1, and multi-grade oil as engine oil (SAE Engine Oil Viscosity Number 10W30), as described above.

The results are shown in Table 2 below.

Example A2

A sample oil A2 was prepared by adding a lubricant oil of viscosity 4.7 mm$^2$/s (100° C.) (150 neutral oil) to the gasoline additive composition of Example A1 such that it contained 100 ppm by weight of the oil on the basis of the total weight of gasoline. Data of n-d-M analysis of the lubricant oil showed 70.0% paraffin carbon atoms, 25.0% naphthese carbon atoms and 5.0% carbon atoms on the basis of the total number of carbon atoms.

The same experiment as in Example A1 was carried out using this sample oil A2, and the results are shown in Table 2.

Example A3

A sample oil A3 was prepared by replacing the ester of Example A1 with the same quantity of diisononyladipate. The same experiment as in Example A1 was carried out using this sample oil A3, and the results are shown in Table 2.

Comparative Example A1

A comparison oil 1 was prepared using only gasoline without the addition of the additive in Example A1. The same experiment as in Example A1 was carried out,and the results are shown in Table 2.

The results show that in the case of all the sample oils A1–A3, adhesion of the deposits is reduced and cleanliness is improved as compared to the case of comparison oil A1

TABLE 2

| | Adhesion Assessment (1) | Average Weight of Deposit (mg/intake valve) |
|---|---|---|
| Sample oil A1 | 9.0 | 59 |
| Sample oil A2 | 9.0 | 56 |
| Sample oil A3 | 9.0 | 58 |
| Comparison oil A1 | 7.5 | 156 |
| | | (1) CRC method |

Example B1 (Dispersant Component=Benzylamine Derivative)

A sample oil B1 was prepared by adding:

(1) 300 ppm by weight on the basis of the total weight of gasoline, of the benzylamine derivative with the structural formula below (average molecular weight 2500):

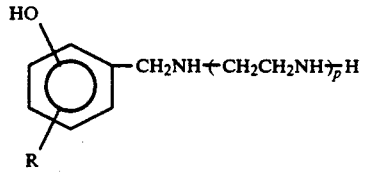

where R is a polyisobutenyl group with a weight average molecular weight of 2000 and p is approximately 8, and (2) 200 ppm by weight on the basis of the total weight of gasoline, of trimethylolpropane/tri-(2-ethylhexanoate), to gasoline of density 0.752 g/cm$^2$ (15° C.) Reid vapor pressure 0.750 Kgf/cm$^2$ (37.8° C.), aromatic content 40.2% and olefine content 19.6%, and 10%-, 50%-, 90%-recovered-temperature 46.5° C., 99.0° C., 147.0° C., respectively.

In preparing the sample, oil temperature was 40°–60° C., and stirring time was approx. 30 minutes.

An experiment was then carried out to measure deposits on the air intake valves of an actual automobile using this sample oil B1, and a multi-grade oil (SAE Engine Oil Viscosity Number 10W30) as engine oil, as described above.

The results are shown in Table 3 below.

Example B2

A sample oil B2 was prepared by adding a lubricant oil fraction of viscosity 4.7 mm$^2$/s (100° C.) (150 neutral oil) to the gasoline additive composition of Example B1 such that it contained 100 ppm by weight of the fraction on the basis of the total weight of gasoline Data of n-D-m analysis of the lubricant oil showed 70.0% paraffin carbon atoms, 25.0% naphthene carbon atoms and 5.0% carbon atoms on the basis of the total number of carbon atoms.

The same experiment as in Example B1 was carried out using this sample oil B2, and the results are shown in Table 3.

Example B3

A sample oil B3 was prepared by replacing the ester of Example B1 with the same quantity of diisononyladipate. The same experiment as in Example B1 was carried out using this sample oil B3, and the results are shown in Table 3.

Comparative Example B1

A comparison oil 1 was prepared using only gasoline without the addition of the additive in Example B1. The same experiment as in Example B1 was carried out, and the results are shown in Table 3.

The results show that in the case of all the sample oils B1–B3, adhesion of the deposits is reduced and cleanliness is improved as compared to the case of comparison oil B1.

TABLE 3

| | Adhesion Assessment (1) | Average Weight of Deposit (mg/intake valve) |
|---|---|---|
| Sample oil B1 | 8.8 | 65 |
| Sample oil B2 | 8.9 | 62 |
| Sample oil B3 | 8.9 | 63 |
| Comparison oil B1 | 7.5 | 156 |
| | | (1) CRC method |

2nd Aspect

Example C1 (Dispersant Component=Succinimide).

A sample oil C1 was prepared by adding:

(1) 200 ppm by weight of trimethylolpropane/tri-(2-ethylhexanoate), (2) 100 ppm by weight of polyoxypropylene glycol (molecular weight 1000), and (3) 100 ppm of a succinimide mixture comprising 50 wt % of a commercial mono-type succinimide (containing 20 wt % of the bis form) having a polyethylene polyamine moiety with m=4, $R_1$ of a polyisobutenyl group and a molecular weight of approx. 1500 (as measured by GPC), and 50 wt % of a commercial bis-type succinimide (containing 20 wt % of the mono form) having a polyethylene polyamine moiety with n=3, $R_3$ & $R_3'$ of polyisobutenyl groups and a molecular weight of approx. 2500 (as measured by GPC), to gasoline of density 0.752 g/cm$^2$ (15° C.), Reid vapor pressure 0.750 Kgf/cm$^2$ (37.8° C.), aromatic content 40.2% and olefine content 19.6%, and 10%-, 50%-, 90%-recovered-temperature 46.5° C., 99.0° C., 147.0° C., respectively.

In preparing the sample, oil temperature was 40°–60° C., and stirring time was approx. 30 minutes.

An experiment was then carried out to measure deposits on the air intake valves of an actual automobile using this sample oil C1, and a multi-grade oil as engine oil (SAE Engine Oil Viscosity Number 10W30), as described above.

The results are shown in Table 4 below.

Example C2

A sample oil C2 was prepared by adding a lubricant oil of viscosity 4.7 mm$^2$/s (100° C.) (150 neutral oil) to the gasoline additive composition of Example C1 such that it contained 100 ppm by weight of the oil on the basis of the total weight of gasoline. Data of n-d-M analysis of the lubricant oil showed 70.0% paraffin carbon atoms, 25.0% naphthene carbon atoms and 5.0% carbon atoms on the basis of the total number of carbon atoms.

The same experiment as in Example C1 was carried out using this sample oil C2, and the results are shown in Table 4.

Example C3

A sample oil C3 was prepared in the same way as in Example C1, except that the polyolester of Example C1 was replaced with 300 ppm by weight of di-isodecyladipate.

The same experiment as in Example C1 was carried out using this sample oil C3, and the results are shown in Table 4.

Example C4

A sample oil C4 was prepared by replacing the polyoxypropylene glycol of Example C1 with the same quantity of polyoxypropylene glycol monobutyl ether. (average molecular weight 1100). The same experiment as in Example C1 was carried out using this sample oil C4, and the results are shown in Table 4.

Example C5

A sample oil C5 was prepared by replacing the polyoxypropylene glycol of Example C1 with the same quantity of acetic acid ester of polyoxypropylene glycol monobutyl ether(average molecular weight 1100).

The same experiment as in Example C1 was carried out using this sample oil C5, and the results are shown in Table 4.

Example C6

A sample oil C6 was prepared by replacing the polyoxypropylene glycol of Example C1 with the same quantity of the ester derived from polyoxyisobutylene glycol monobutyl ether and 3-aminopropionic acid, represented by the formula:

$$n\text{-}C_4H_9-O-(\overset{\overset{C_2H_5}{|}}{C}H-CH_2O)_w-CO-CH_2-CH_2NH_2$$

(average molecular weight 1000, thermal decomposition starting temperature 320° C.).

The same experiment as in Example C1 was carried out using this sample oil C6, and the results are shown in Table 4.

Comparative Example C1

A comparison oil C1 was prepared using only gasoline without the addition of the additive in Example C1. The same experiment as in Example C1 was carried out, and the results are shown in Table 4.

The results show that in the case of all the sample oils C1-C6, adhesion of the deposits is reduced and cleanliness is improved as compared to the case of comparison oil C1.

TABLE 4

| | Adhesion Assessment (1) | Average Weight of Deposit (mg/air intake valve) |
|---|---|---|
| Sample oil C1 | 9.0 | 50 |
| Sample oil C2 | 9.0 | 48 |
| Sample oil C3 | 9.0 | 44 |
| Sample oil C4 | 9.0 | 48 |
| Sample oil C5 | 9.0 | 45 |
| Sample oil C6 | 9.0 | 39 |
| Comparison oil C1 | 7.5 | 156 |

(1) CRC method

Example D1 (Dispersant Component=Alkylamine )

A sample oil D1 was prepared by adding:

(1) 100 ppm by weight on the basis of the total weight of gasoline, of polyisobutenylamine (average molecular weight 1500), (2) 200 ppm by weight on the basis of the total weight of gasoline, of trimethylolpropane/tri-(2-ethylhexanoate), and (3) 100 ppm by weight on the basis of the total weight of gasoline, of polyoxypropylene glycol (average molecular weight 1000), to gasoline of density 0.752 g/cm$^2$ (15° C.), Reid vapor pressure 0.750 Kgf/cm$^2$ (37.8° C.), aromatic content 40.2% and olefine content 19.6%, and 10%-, 50%-, 90%-recovered-temperature 46.5° C., 99.0° C., 147.0° C., respectively.

In preparing the sample, oil temperature was 40-60° C., and stirring time was approx 30 minutes.

An experiment was then carried out to measure deposits on the intake valves of an actual automobile using this sample oil D1, and a multi-grade oil as engine oil (SAE Engine Oil Viscosity Number 10W30), as described above.

The results are shown in Table 5 below.

Example D2

A sample oil D2 was prepared by adding a lubricant oil of viscosity 4.7 mm$^2$/s (100° C.) (150 neutral oil) to the gasoline additive composition of Example D1 such that it contained 100 ppm by weight of the oil on the basis of the total weight of gasoline. Data of n-d-M analysis of the lubricant oil showed 70.0% paraffin carbon atoms, 25.0% naphthene carbon atoms and 5.0% carbon atoms on the basis of the total number of carbon atoms.

The same experiment as in Example D1 was carried out using this sample oil D2, and the results are shown in Table 5.

Example D3

A sample oil D3 was prepared in the same way as in Example D1, except that the ester of Example D1 was replaced by the same quantity of di-isononyladipate. The same experiment as in Example D1 was carried out using this sample oil D3, and the results are shown in Table 5.

Example D4

A sample oil D4 was prepared by replacing the polyoxypropylene glycol of Example D1 with the same quantity of polyoxypropylene glycol monobutyl ether (average molecular weight 1100). The same experiment as in Example D1 was carried out using this sample oil D4, and the results are shown in Table 5.

Example D5

A sample oil D5 was prepared by replacing the polyoxypropylene glycol of Example D1 with the same quantity of acetic acid ester of polyoxypropylene glycol (average molecular weight 1100).

The same experiment as in Example D1 was carried out using this sample oil D5, and the results are shown in Table 5.

Example D6

A sample oil D6 was prepared by replacing the polyoxypropylene glycol of Example D1 with the same quantity of the ester represented by the formul derived from polyoxyisobutylene glycol monobutyl ether and 3-aminopropionic acid, represented by the formul:

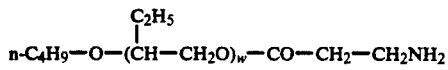

(average molecular weight 1000, thermal decomposition temperature 320° C.).

The same experiment as in Example D1 was carried out using this sample oil D6, and the results are shown in Table 5.

Comparative Example D1

A comparison oil D1 was prepared using only gasoline without the addition of the additive in Example D1. The same experiment as in Example D1 was carried out, and the results are shown in Table 5.

The results show that in the case of all the sample oils D1-D6, adhesion of the deposits is reduced and cleanliness is improved as compared to the case of comparison oil D1.

TABLE 5

| | Adhesion Assessment (1) | Average Weight of Deposit (mg/intake valve) |
|---|---|---|
| Sample oil D1 | 9.0 | 53 |
| Sample oil D2 | 9.0 | 50 |
| Sample oil D3 | 9.0 | 52 |
| Sample oil D4 | 9.0 | 50 |
| Sample oil D5 | 9.0 | 48 |
| Sample oil D6 | 9.0 | 43 |
| Comparison oil D1 | 7.5 | 156 |

(1) CRC method

Example E1 (Dispersant Component = Benzylamine derivative)

A sample oil E1 was prepared by adding:

(1) 100 ppm by weight on the basis of the total weight of gasoline, of the benzylamine derivative with the structural formula below (average molecular weight 2500):

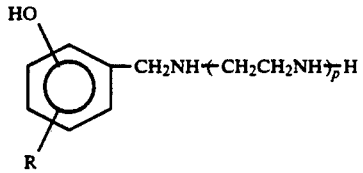

where R is a polyisobutenyl group with a weight average molecular weight of 2000 and p is approximately 8, (2) 200 ppm by weight on the basis of the total weight of gasoline, of trimethylolpropane/tri-(2-ethylhexanoate), and (3) 100 ppm by weight on the basis of the total weight of gasoline, of polyoxypropylene glycol (average molecular weight 1000), to gasoline of density 0.752 g/cm$^2$ (15° C.), Reid vapor pressure 0.750 Kgf/cm$^2$ (37.8° C.), aromatic content 40.2% and olefine content 19.6%, and 10%-, 50%-, 90%-recovered-temperature 46.5° C., 99.0° C., 147.0° C., respectively.

In preparing the sample, oil temperature was 40°-60° C., and stirring time was approx. 30 minutes.

An experiment was then carried out to measure deposits on the air intake valves of an actual automobile using this sample oil E1, and a multi-grade oil as engine oil (SAE Engine Oil Viscosity Number 10W30), described above.

The results are shown in Table 6 below.

Example E2

A sample oil E2 was prepared by adding a lubricant oil of viscosity 4.7 mm$^2$/s (100° C.) (150 neutral oil) to the gasoline additive composition of Example E1 such that it contained 100 ppm by weight of the oil on the basis of the total weight of gasoline. Data of n-d-M analysis of the lubricant oil showed 70.0% paraffin carbon atoms, 25.0% naphthene carbon atoms and 5.0% carbon atoms on the basis of the total number of carbon atoms.

The same experiment as in Example E1 was carried out using this sample oil E2, and the results are shown in Table 6.

Example E3

A sample oil E3 was prepared in the same way as in Example E1, except that the ester of Example E1 was replaced by the same quantity of di-isononyladipate. The same experiment as in Example E1 was carried out using this sample oil E3, and the results are shown in Table 6.

Example E4

A sample oil E4 was prepared by replacing the polyoxypropylene glycol of Example E1 with the same quantity of polyoxypropylene glycol monobutyl ether (average molecular weight 1100). The same experiment as in Example E1 was carried out using this sample oil E4, and the results are shown in Table 6.

Example E5

A sample oil E5 was prepared by replacing the polyoxypropylene glycol of Example E1 with the same quantity of acetic acid ester of polyoxypropylene glycol (average molecular weight 1100).

The same experiment as in Example E1 was carried out using this sample oil E5, and the results are shown in Table 6.

Example E6

A sample oil E6 was prepared by replacing the polyoxypropylene glycol of Example E1 with the same quantity of the ester derived from polyoxyisobutylene glycol monobutyl ether and 3-aminopropionic acid, represented by the formula:

$$n\text{-}C_4H_9-O-(\underset{}{\overset{C_2H_5}{\overset{|}{CH}}}-CH_2O)_w-CO-CH_2-CH_2NH_2$$

(average molecular weight 1000, thermal decomposition starting temperature 320° C.).

The same experiment as in Example E1 was carried out using this sample oil E6, and the results are shown in Table 6.

Comparative Example E1

A comparison oil E1 was prepared using only gasoline without the addition of the additive in Example E1. The same experiment as in Example E1 was carried out, and the results are shown in Table 6.

The results show that in the case of all the sample oils E1-E6, adhesion of the deposits is reduced and cleanliness is improved as compared to the case of comparison oil E1.

TABLE 6

| | Adhesion Assessment (1) | Average Weight of Deposit (mg/intake valve) |
|---|---|---|
| Sample oil E1 | 9.0 | 57 |
| Sample oil E2 | 9.0 | 55 |
| Sample oil E3 | 9.0 | 58 |
| Sample oil E4 | 9.0 | 55 |
| Sample oil E5 | 9.0 | 53 |
| Sample oil E6 | 9.0 | 48 |
| Comparison oil E1 | 7.5 | 156 |
| | | (1) CRC method |

What is claimed is:

1. A gasoline additive composition comprising at least one of trimethylolpropane-tri-(2-ethylhexanoate) and di-isodecyl adipate and at least one dispersant component selected from the group consisting of:

(1) a mixture of a monosuccinimide represented by the formula (I) below and a bissuccinimide represented by the formula (II) below.

(2) an alkylamine of average molecular weight 500-5000 having a polyolefin polymer as an alkyl group, (3) a benzylamine derivative of an average molecular weight 500-5000 represented by the formula (III) below, provided by weight of the dispersant component where (I), (II) and (III) are:

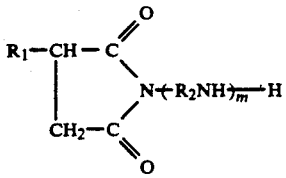

(I)

where $R_1$ is an olefin oligomer group with at least 30 carbon atoms, $R_2$ is an alkylene group with 2 to 4 carbon atoms, and m is an integer of 1-10,

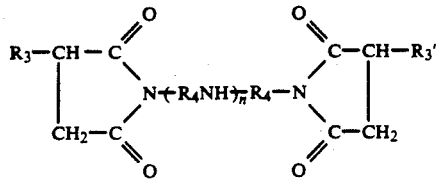

(II)

where each of $R_3$ and $R_3'$ is an olefin oligomer group with at least 30 carbon atoms, $R_4$ is an alkylene group with 2 to 4 carbon atoms, provided that the $R_4$ groups may be the same as or different from each other, and n is an integer of 0-10, and

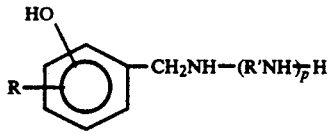

(III)

where R is an alkyl group derived from a polyolefin polymer of an average molecular weight of 500 to 4500, R' is an alkylene group, and p is an integer of 1 to 10; and (4) a lubricant oil fraction of a viscosity in the range 3-35 $mm^2/g$ (100° C.) in am amount of 0.1 to 5 parts by weight of the composition per part by weight of the fraction.

2. The composition according to claim 1, wherein said dispersant is a mixture of said monsuccinic and bissuccinic acids.

3. The composition according to claim 1, wherein said dispersant component is said alkylamine.

4. The composition according to claim 1, wherein said dispersant component is said benzylamine derivative.

5. The composition according to claim 3, wherein said alkylamine has a polypropylene group or a polyisobutylene group or both as the alkyl group.

6. The composition according to claim 4 wherein said benzylamine derivative has a moiety $CH_2NH(CH_2CH_2NH)_nH$ bound to the aromatic ring of the bynzylamine, wherein n is selected to provide a molecular weight of the benzylamine in the range of 500 to 5000.

7. A gasoline additive composition comprising:

(a) an ester;

(b) at least one dispersant component selected from the group consisting of (1) at least one monosuccinimide represented by the formula (I) below, (2) a bissuccinimide represented by the formula (II) below, (3) an alkylamine of an average molecular weight 500-5000 having a polyolefin polymer as an alkyl group, and (4) a benzylamine derivative of an average molecular weight 500-5000 represented by the general formula (III) below provided the gasoline additive composition contains 0.5 to 6 parts by weight of the dispersant component per part by weight of the ester; and (c) a polyoxyalkylene glycol or a derivative thereof having an average molecular weight of 500 to 5000, present in an amount of 0.2 to 4 parts by weight of the glycol or derivative per part by weight of the ester, where (I), (II) and (III) are:

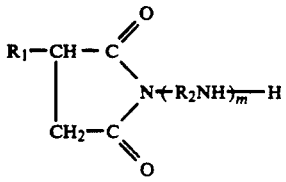

(I)

where $R_1$ is an olefin oligomer group with at least 30 carbon atoms, $R_2$ is an alkylene group with 2 to 4 carbon atoms, and m is an integer of 1–10,

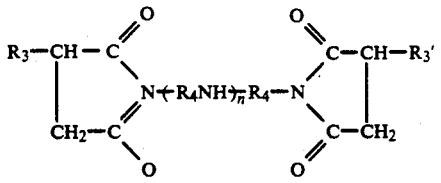

(II)

where each of $R_3$ and $R_3'$ is an olefin oligomer group with at least 30 carbon atoms, $R_4$ is an alkylene group with 2 to 4 carbon atoms, provided that the $R_4$ groups may be the same as or different from each other, and n is an integer of 0–10, and

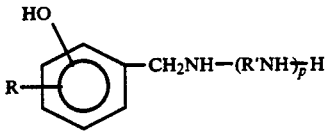

(III)

where R is an alkyl group derived from a polyolefin polymer of an average molecular weight of 500 to 4500, R' is an alkylene group, and p is an integer of 1 to 10.

8. The composition according to claim 7 which further incorporates a lubricant oil fraction of viscosity in the range 3–35 $mm^2/g$ (100° C.) into the composition so as to keep a level of 0.1 to 5 parts by weight of the composition per part by weight of the fraction.

9. The composition according to claim 7, wherein said dispersant component is said monsuccinic acid and said bissuccinic acid or a mixture of the two.

10. The composition according to claim 7, wherein said dispersant component is said alkylamine.

11. The composition according to claim 7, wherein said dispersant component is said benzylamine derivative.

12. The composition according to claim 7, wherein said ester is trimethylolpropane ester.

13. The composition according to claim 7, wherein said ester is diester.

14. The composition according to claim 8, wherein said ester is trimethylolpropane ester.

15. The composition according to claim 8, wherein said ester is diester.

16. The composition according to claim 7, wherein said dispersant is a mixture of monosuccinic acid and bissuccinic acid in a ratio of 70:30 to 30:70.

17. The composition according to claim 10, wherein said alkylamine has a polypropylene group and/o a polyisobutylene group as the alkyl group.

18. The composition according to claim 11 wherein said benzylamine derivative has a moiety $CH_2NH(CH_2CH_2NH)_nH$ bound to the aromatic ring of the benzylamine, wherein n is selected to keep the molecular weight of the benzylamine within 500 to 5000.

19. The composition according to claim 7 wherein said ester is a diester derived from at least one alcohol selected from 2-ethylhexanol, isononylalcohol and isodeceylalcohol, and at least one acid selected from adipic acid, azelaic acid, sebacic acid and phthalic acid.

* * * * *